US005943888A

United States Patent [19]

Lawson

[11] Patent Number: 5,943,888

[45] Date of Patent: Aug. 31, 1999

[54] KEYLESS ENTRY MECHANISM

[76] Inventor: Edward Lawson, 470 First Ave. South, Bayport, Minn. 55003

[21] Appl. No.: 08/990,975

[22] Filed: Dec. 15, 1997

[51] Int. Cl.[6] ..... E05B 49/00

[52] U.S. Cl. ..... 70/278; 292/341.15; 292/254; 70/461

[58] Field of Search ..... 70/277–282, 92, 70/461; 292/DIG. 25, 60, 144, 251.5, 254, 340, 341.13, 341.15, 341.16

[56] References Cited

U.S. PATENT DOCUMENTS

| | | | |
|---|---|---|---|
| D. 360,124 | 7/1995 | Gartner . | |
| 2,012,693 | 8/1935 | Rieback | 292/341.15 X |
| 3,521,921 | 7/1970 | Miyazaki | 292/254 X |
| 3,749,435 | 7/1973 | Balzano | 292/341.16 |
| 3,756,642 | 9/1973 | Fulton | 292/341.15 |
| 3,758,142 | 9/1973 | Gartner | 292/254 |
| 3,774,422 | 11/1973 | Hogan et al. | 292/341.16 X |
| 3,861,727 | 1/1975 | Froerup et al. | 292/341.16 |
| 3,998,483 | 12/1976 | Yan | 292/341.15 X |
| 5,021,776 | 6/1991 | Anderson et al. . | |
| 5,043,720 | 8/1991 | Laurienzo . | |
| 5,085,061 | 2/1992 | Maudsley | 70/279.1 X |
| 5,219,193 | 6/1993 | Piltingsrud . | |
| 5,280,881 | 1/1994 | Karmin | 70/277 X |
| 5,474,342 | 12/1995 | Smith et al. | 292/341.16 X |
| 5,531,086 | 7/1996 | Bryant . | |
| 5,609,051 | 3/1997 | Donaldson . | |
| 5,613,718 | 3/1997 | Lin | 292/341.15 X |
| 5,690,372 | 11/1997 | Jans | 292/DIG. 60 X |
| 5,713,612 | 2/1998 | Kajuch | 292/DIG. 60 X |
| 5,729,198 | 3/1998 | Gorman | 70/279.1 X |
| 5,865,483 | 2/1999 | Dubravin | 292/254 X |

FOREIGN PATENT DOCUMENTS

| | | | |
|---|---|---|---|
| 368390 | 2/1923 | Germany | 70/461 |
| 2222839 | 11/1973 | Germany | 70/461 |

*Primary Examiner*—Suzanne Dino Barrett
*Attorney, Agent, or Firm*—Skinner and Associates

[57] ABSTRACT

A keyless entry mechanism for opening a lock, generally comprising a housing, an operating shaft positioned within said housing and operably aligned to extend out of said housing to contact a bolt of the lock, a shaft drive positioned within said housing and operably connected to said operating shaft to extend said operating shaft, and an actuation mechanism operationally positioned within said housing for extending said shaft. The operating shaft is manually retracted and latched against the shaft drive. Upon receiving an actuation signal, the actuation mechanism releases the latched shaft drive allowing it to extend against the bolt and push the bolt into the door. The keyless mechanism simultaneously unlocks and unlatches the door.

12 Claims, 4 Drawing Sheets

KEYLESS ENTRY MECHANISM

BACKGROUND OF THE INVENTION

1. Field of the Invention.

The present invention relates, generally, to keyless entry systems. More particularly, the invention relates to keyless entry systems for unlocking and unlatching doors.

2. Background Information.

The state of the art generally includes various keyless entry systems. These systems include various methods for authenticating the identity of a person authorized to enter through a door, such as entering a code on a keypad or swiping a card through a magnetic strip reader. U.S. Pat. No. 5,609,051 discloses a keyless entry system designed to replace existing key locks. Codes are entered on a keypad to extend and retract a solenoid slug. An extended slug engages a ratchet in a camlock and locks the dead bolt in an extended position. U.S. Pat. No. 5,531,086 discloses a keyless entry dead bolt lock which extends and retracts an existing dead bolt. A remote control transmitter and receiver are used to activate a motor and worm gear. The motor pushes and pulls a rod that rotates a crank to extend and retract the dead bolt. This lock is designed to work only with a dead bolt.

These devices and methods are believed to have significant limitations and shortcomings. Specifically, they are difficult to install in existing doors, and they fail to efficiently unlock and unlatch the door. Applicant's invention provides a keyless entry system which is believed to overcome the limitations and shortcomings of the known art.

BRIEF SUMMARY OF THE INVENTION

The present invention provides a keyless entry mechanism which generally comprises a housing, a power supply, an operating shaft, a shaft drive for extending the operating shaft into contact with a bolt, and an actuation mechanism for triggering the extension of the operating shaft. The operating shaft, shaft drive and actuation mechanism are generally contained by the housing. The keyless entry mechanism is operably positioned inside of a wall adjacent to a lock in a door. The operating shaft of the keyless entry mechanism is aligned with the bolt in such a manner as to push the bolt from a locked and latched position to an unlocked and unlatched position when the operating shaft is extended flush with the strike plate. The shaft drive is preferably a spring. The keyless entry system is readied or cocked when the operating shaft is manually retracted a predetermined distance against the force of the spring, at which point a notch in the operating shaft latches with a catch in the actuation mechanism. A release system removes the catch from the notch upon receiving an actuation signal, and allows the shaft drive to extend the operating shaft and push the bolt out of the strike plate and into the door.

The keyless entry mechanism works well for residential-style dead bolt locks and spring-loaded locks. Furthermore, it can be used for single family dwellings or in multi-unit dwellings such as apartment buildings. In an apartment building, for example, a code could be entered that unlocks and unlatches the main door as well as the individual's apartment door.

Significant features of the invention are disclosed in the following non-exhaustive list.

(1) The mechanism is located within the wall rather than within the door. This is significant because it is often easier or preferable to cut drywall or block rather than an expensive door or a glass door.

(2) The mechanism uses mechanically stored energy in the form of springs to unlock door rather than expensive motors and gears.

(3) The mechanism unlocks and unlatches the door so that it can be pushed open without turning a knob.

(4) The functionality of the original lock remains intact so that the original key can still be used to open the door. This is desirable if the power is out or if the device malfunctions.

The features, benefits and objects of this invention will become clear to those skilled in the art by reference to the following description, claims and drawings.

DETAILED DESCRIPTION

Figure 1:
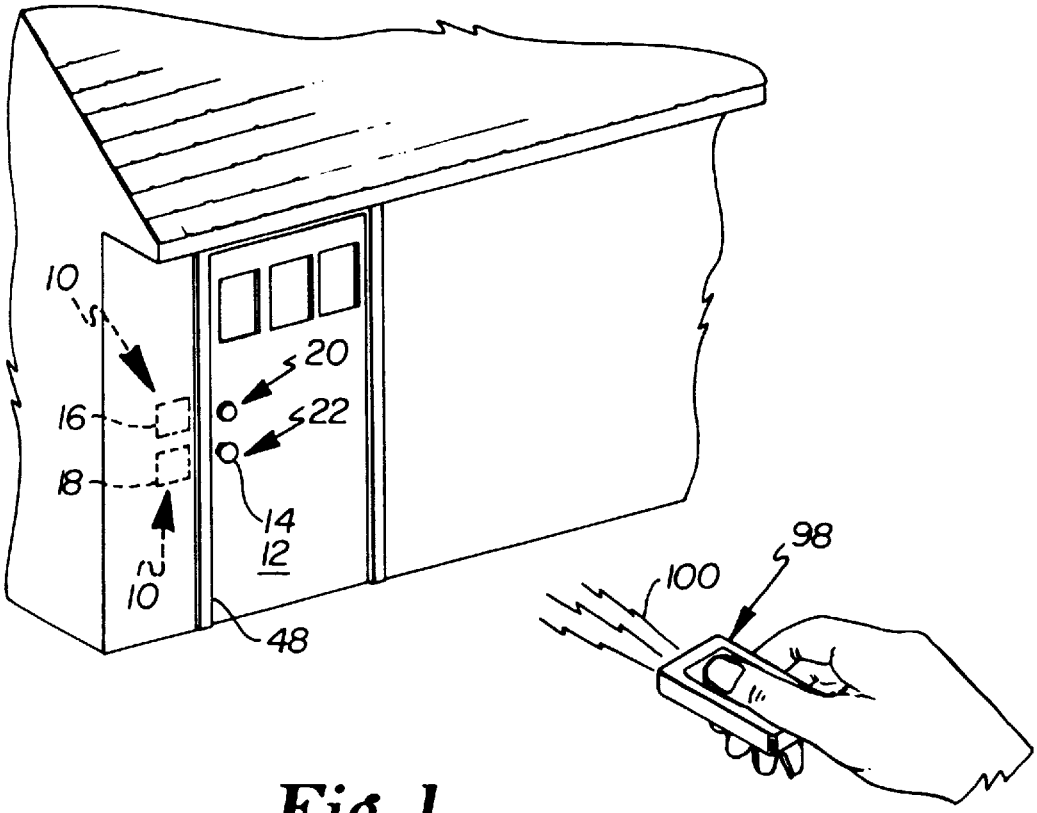
FIG. 1 is a partial perspective view of a residential building and a hidden view of the present invention positioned near a door having both a dead bolt lock and a spring-loaded lock.

Referring to FIGS. 1–6, examples of preferred embodiments of the keyless entry mechanism are illustrated and generally indicated by the reference numeral 10. The keyless entry mechanism 10 is described below first in terms of its major structural elements and then in terms of its secondary structural and/or functional elements which cooperate to unlock and unlatch a door.

Figure 2:
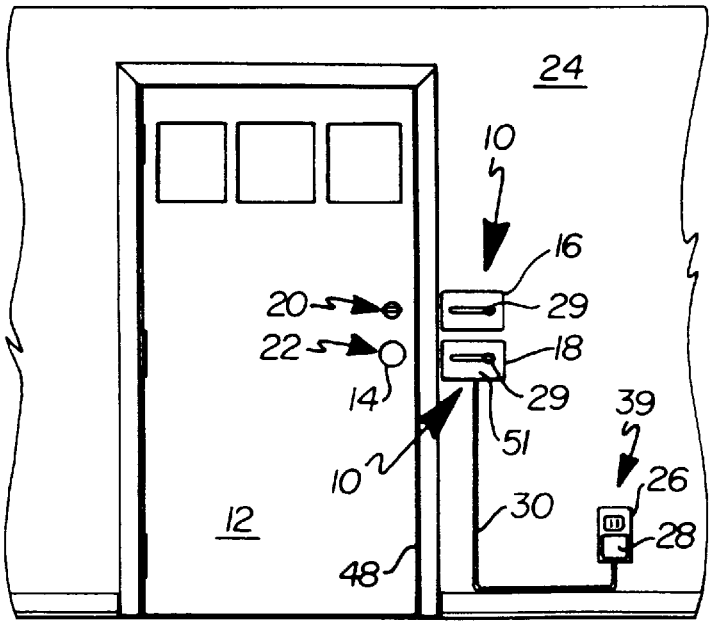
FIG. 2 is a planar view of the door of FIG. 1 from the interior of the residential building.

FIGS. 1 and 2 illustrate the general purpose of the keyless entry mechanism 10, which is to unlock and unlatch a door 12 without using a key. The door can be pushed or pulled open without turning a handle 14. The keyless entry mechanism 10 works well either as a dead bolt keyless entry 16 or a spring-loaded keyless entry 18. FIG. 1 shows a remote radio frequency transmitter as a preferred method of actuating the unlocking and unlatching function of the keyless entry. However, other devices that provide an authenticated or generally secure signal could be used to activate the unlocking and unlatching function. Other known security devices include, but are not limited to, keypads upon which an alpha-numeric code is entered, magnetic strip card readers, and voice recognition. FIG. 2 shows the interior wall 24 and the interior of the door 12 of the residence. The keyless entry mechanisms 16 and 18 are powered with low voltage power, which is easily transformed from common 120 VAC residential power. As shown, a low voltage transformer 26 may be plugged into a typical power receptacle 28 and low voltage wiring 30 may be run on the surface of the interior wall 24 to the keyless entry mechanism 10.

The keyless entry mechanism 10 of the present invention is typically used in the following fashion. Assuming that the keyless entry mechanism 10 has been "set" or "cocked" and that the door has been conventionally locked, a person uses a remote control to actuate the keyless entry mechanism 10 to unlock and unlatch the door 12. The person enters the building by pushing or pulling the door open without turning a handle. Upon entering the building, the person manually resets or cocks the keyless entry mechanism 10 by pulling back on the cocking handle 28. The person relocks the door as normal upon leaving the building. Having been previously reset or cocked, the keyless mechanism 10 is ready to unlock and unlatch the door upon desired entry again.

Embodiments of the keyless entry mechanism 10 are shown in FIG. 3–6. The keyless entry mechanism 10 generally comprises a housing 32, an actuation mechanism 34, an operating shaft 36, a shaft drive 38, and a power supply 39. When the person signals the keyless entry mechanism 10 to unlock and unlatch a dead bolt lock 20 or spring-loaded lock 22, the actuation mechanism 34 is energized causing the shaft drive 38 to extend the operating shaft 36, which either pushes the dead bolt 40 or pushes both the spring-loaded bolt 42 and lock pin 44 into the door 12. The housing 32 generally contains the actuation mechanism 34, the shaft drive 38, and the operation shaft 36, and it generally comprises a recessed box 50 attached between wall studs 52, a face plate 51 attached over the recessed box 50 and flush with the wall, and a channel 54 for providing a passage from the box 50, through wall studs 52, and to the strike plate 46. The power supply 39 is low voltage and is easily transformed from common 120 VAC residential line voltage. The figures show a power supply 39 comprising a common duplex power receptacle 26, a plug-type low voltage power transformer 28, and low voltage wiring 30. Alternatively, the power transformer 28 could be hard wired to the residential line voltage. The power supply 39 provides the electrical power required to operate the actuation mechanism 34. The power supply 39 could also provide power to the shaft drive 38 if a motor and gear system is used rather than springs.

Figure 3:
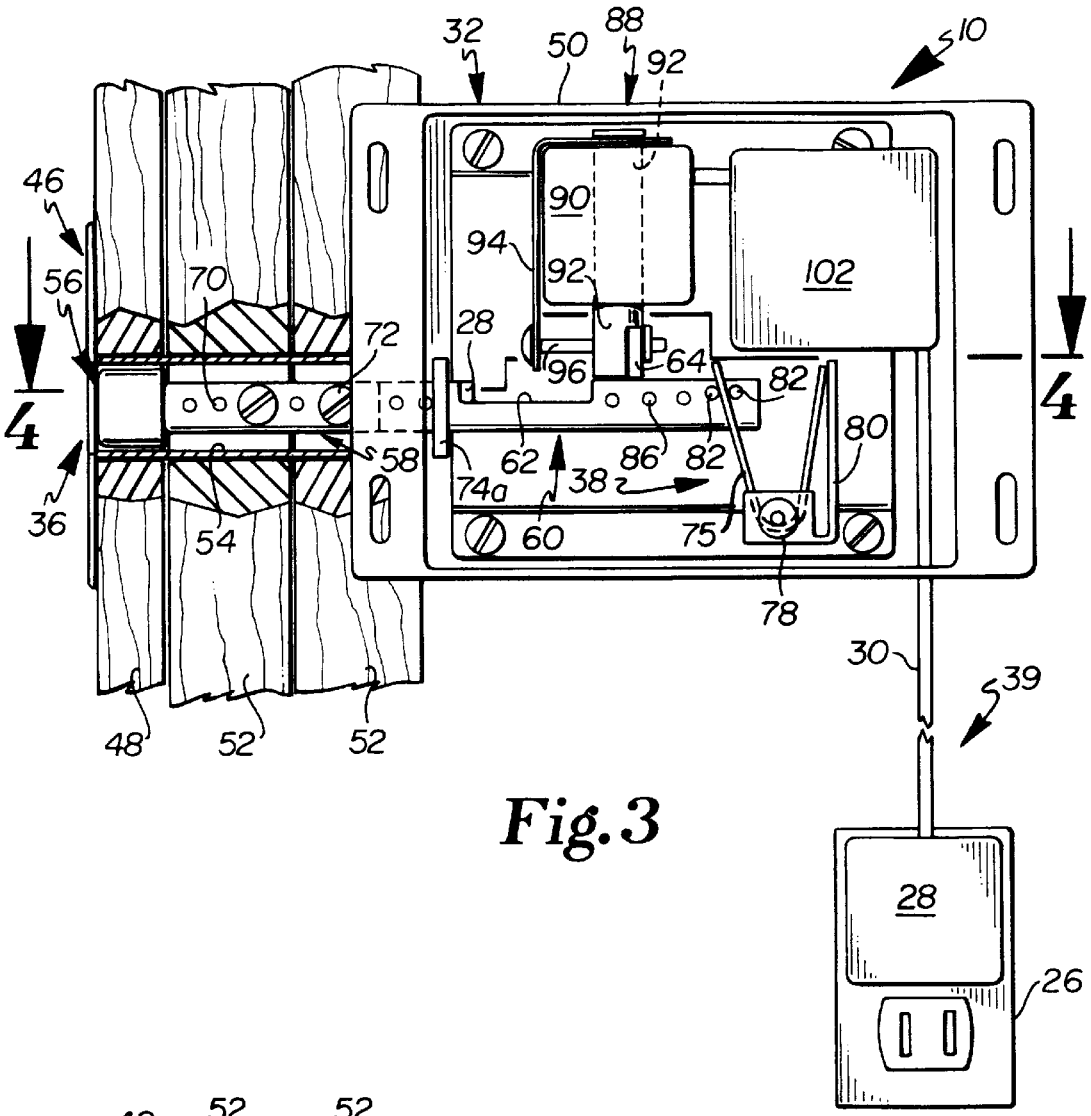
FIG. 3 is a cross-sectional view of the keyless entry mechanism of the present invention.
Figure 4:
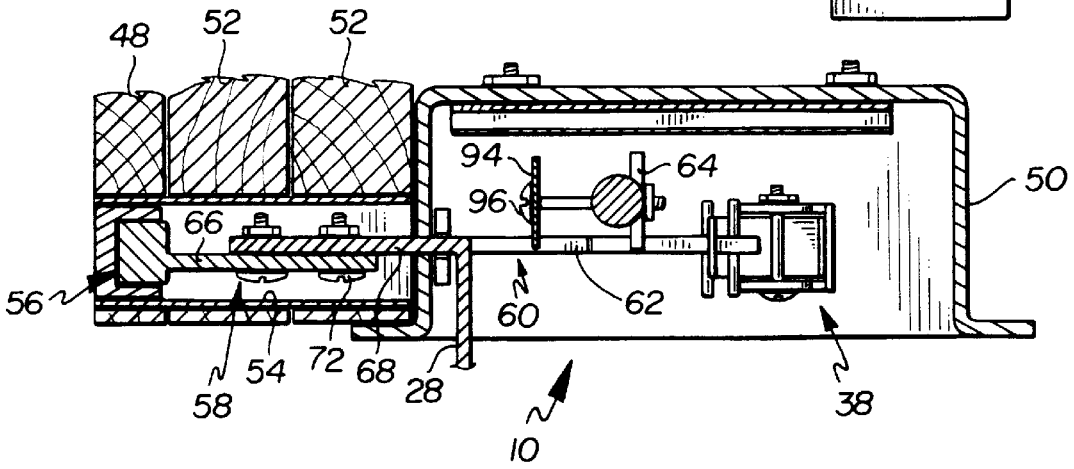
FIG. 4 is a cross-sectional view of the keyless entry mechanism taken along line 4—4 of FIG. 3.
Figure 5:
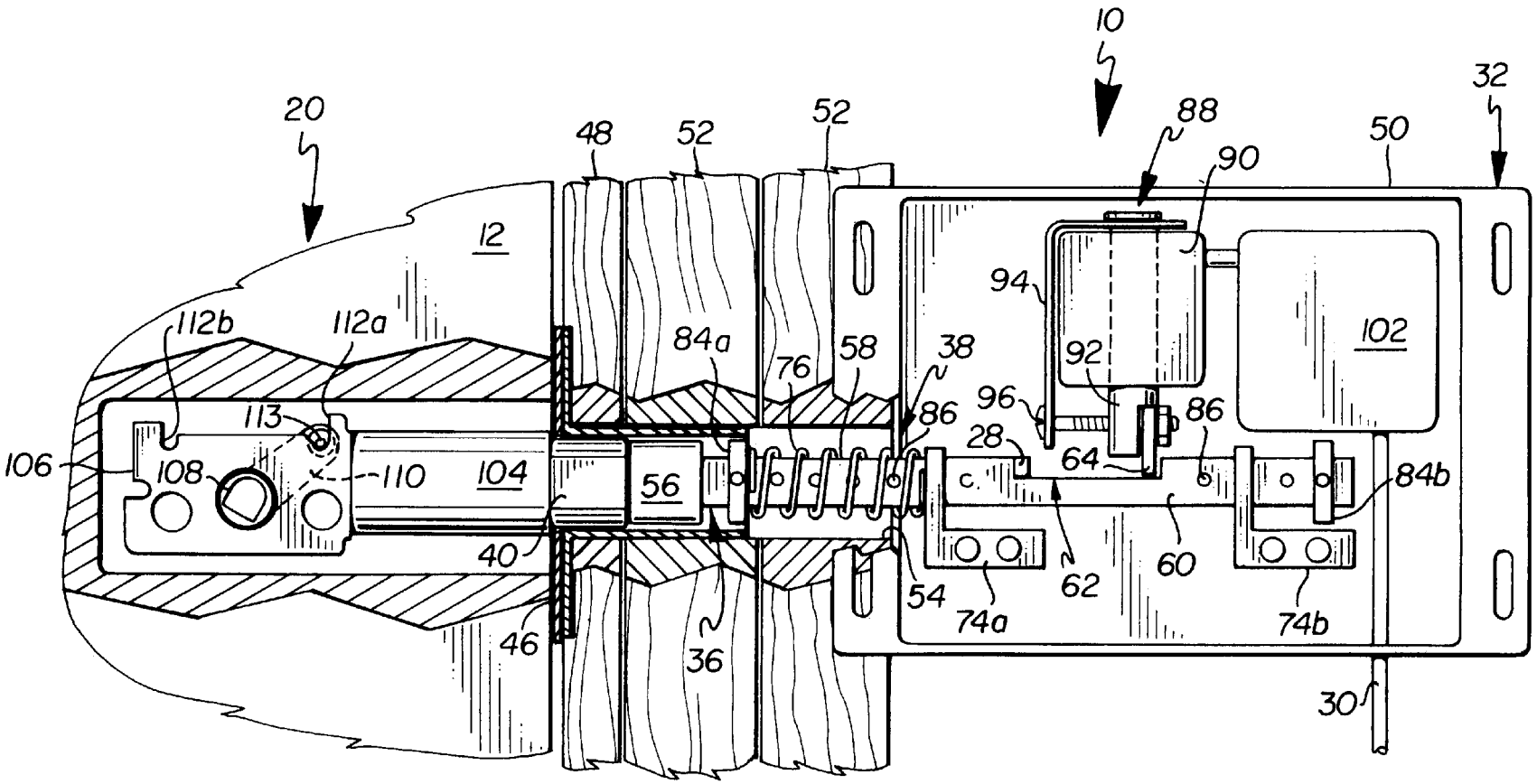
FIG. 5 is a cross-sectional view of an embodiment of the keyless entry mechanism used in conjunction with a dead bolt lock shown in a locked position.

The operating shaft 36 generally comprises a head 56 designed to contact the dead bolt 40 or spring-loaded bolt 42, a neck 58, and a body 60. The body 60 has a notch 62 designed to latch with a release catch 64 in the actuation mechanism 34 when the shaft 36 is retracted or cocked against the spring-type shaft drive 38. A cocking handle 28 attached to the body 60 of the shaft 36 extends out of the housing 32 through the face plate 51 and is used to manually cock the operating shaft 36. As shown in FIGS. 3 and 4, the length of the neck 58 may be adjustable by, for example, using an overlapping distal portion 66 and proximal portion 68, wherein both portion have an aligned set of adjusting apertures 70. Adjustment screws 72 are used to attach the distal 66 and proximal 68 portions together to form a desired shaft length that prevents the head 56 from extending too far beyond the strike plate 46 and into the door 12. As shown in FIG. 5, the operating shaft 36 is supported within the housing 32 by supporting brackets 74.

Figure 6:
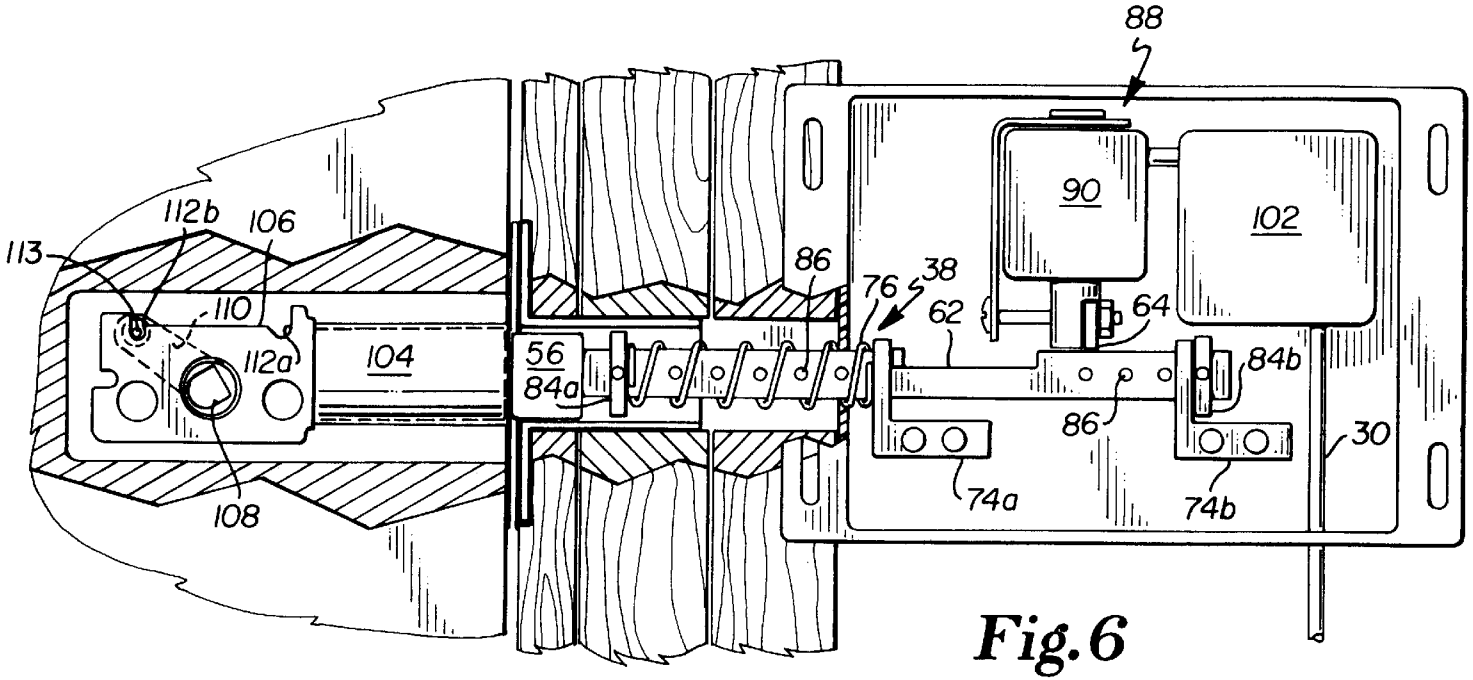
FIG. 6 is a cross-sectional view of the keyless entry mechanism used in conjunction with a dead bolt lock shown in an unlocked position.

The shaft drive 38 is preferably a spring, although the drive 38 could comprise a motor and gear drive, a solenoid, or the like. The shaft drive 38 shown in FIGS. 3 and 4 is a leaf spring 75, and the shaft drive 38 shown in FIGS. 5 and 6 is a coiled or helical spring 76. These springs 75 and 76 are compressed when the operating shaft 36 is retracted or cocked. The release catch 64 latches with the notch 62 of the operating shaft 36 when the keyless entry mechanism 10 is fully retracted. The operating shaft 36 extends and pushes either one of the bolts 40 or 42 into the door 12 when these springs 75 and 76 expand. Alternatively, the keyless entry mechanism 10 could be designed so that the springs 75 and 76 expand when the operating shaft 36 is retracted and return when the operating shaft 36 is released.

The leaf spring 75 shown in FIG. 3 is attached to the housing 32 at a pivot point 78 and is functionally sandwiched between a backstop 80 in the housing 32 and the body 60 of the operating shaft 36. Two projections 82 extend out from the body 60 and clasp an end of the leaf spring 75 in such manner as to allow the operating shaft 36 to compress the spring 75 when it is cocked and to allow the leaf spring 75 to expand and extend the operating shaft 36 when the release catch 64 is removed.

The helical spring 76 shown in FIG. 5 and 6 is positioned around the neck 58 of the operating shaft 36 and is functionally sandwiched between an adjustment bracket 84*a* and a supporting bracket 74. FIG. 5 shows a dead bolt lock 20 in a locked position and the keyless entry mechanism 10 in a cocked positioned, wherein the operating shaft 36 is retracted, the helical spring 76 is compressed, and the release catch 64 is latched in the notch 62 of the shaft 36. FIG. 6 shows the dead bolt lock 20 in an unlocked position and the keyless entry mechanism 10 in an uncocked or actuated position, wherein the release catch 64 has been raised out of the notch 62 of the shaft 36, the operating shaft 36 is extended, and the helical spring is expanded. The adjustment brackets 84 serve two purposes. Adjustment bracket 84*a* can be moved along the neck 58 of the operating shaft 36 in relation to supporting bracket 74*a* based on a specific spring's length and characteristics. Adjustment bracket 84*b* can be moved along the body 60 of the operating shaft 36 in relation to supporting bracket 74*b* to provide a stop that butts against the supporting bracket 74*b* to prevent the operating shaft head 56 from extending beyond the strike plate 46 and into the door 12. The adjustment brackets 84*a* and 84*b* fit around the operating shaft 36 and have screws or pins that fit into one of a plurality of adjustment apertures 86 in the operating shaft 36. These screws or pins set the adjustment brackets 84*a* and 84*b* in a desired position. A set screw design or latching means could also be used to clamp the adjustment brackets 84*a* and 84*b* in place.

The actuation mechanism 34 includes a release system 88 for releasing the operating shaft 36 from its cocked position and allowing the shaft 36 to extend and push a bolt 40 or 42 into the door 12. The release system 88 shown in the figures generally includes the release catch 64, a solenoid 90, a release shaft or slug 92, and both a bracket 94 and pin 96 for connecting the release catch 64 to the slug 92. An energized or actuated solenoid 90 raises the slug 92, and thus raises the release catch 64 out of the notch 62 allowing the operating shaft 36 to extend. The actuation mechanism 34 further includes a transmitter 98 for sending an actuation signal 100, a receiver 102 for receiving the signal 100, and a relay-type system (not shown) for energizing the solenoid 90 upon receiving the actuation signal 100. The transmitter 98/receiver 102 shown in the figures uses radio frequency signals. It is anticipated that other secure, keyless means of providing an actuation signal would function well within the keyless entry system. Examples of such secure, keyless means of providing an actuation signal include password codes entered on keypads, magnetic strip card readers, voice detectors, and any other means for authenticating that the person accessing the premises through the door is authorized. If security is not an issue, than a simple push button or other signaling device may be used to send the actuation signal.

FIGS. 5 and 6 show an embodiment of the keyless entry mechanism 10 used to open a dead bolt lock 20. A dead bolt lock 20 generally comprises a dead bolt 40 located within a sleeve 104, a latch frame 106, a torque blade 108, a crank arm 110 that rotates about the torque blade 108, and a drive pin 112 that is attached to the dead bolt 40 and fits within a slot in the crank arm 110. The drive pin 112 is positioned and arranged to nest within a locked guide slot 112*a* in the latch frame 106 when the dead bolt 40 is in a locked position, and to nest within an unlocked guide slot 112*b* in the latch frame 106 when the dead bolt 40 is in an unlocked position. A key or thumb knob normally rotates the torque blade 108 and crank arm 110 to extend and retract the dead bolt 40. The locked guide slot 112*a* may be beveled using a file to allow the keyless entry mechanism 10 to easily push the dead bolt 40 from a locked to unlocked position. Alternatively, the latch frame 106 may be replaced with a pre-beveled frame. The beveling of the locked guide slot 112*a* does not compromise the security of the dead bolt lock 20.

Figure 9:
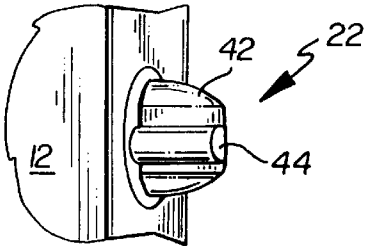
FIG. 9 is a partial perspective view of the bolt and lock pin of a spring-loaded lock.
Figure 8:
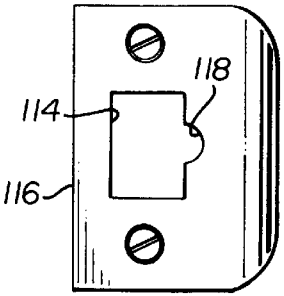
FIG. 8 is a perspective view of a modified strike plate.
Figure 7:
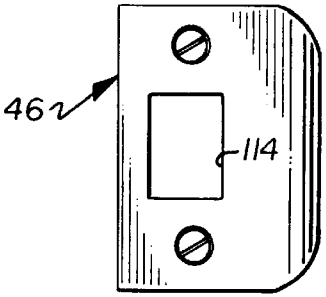
FIG. 7 is a perspective view of a typical strike plate.

The bolt 42 and lock pin 44 of a spring loaded lock 22 of the type found in many residential door handles 14 is shown in FIG. 9. The bolt 42 and lock pin 44 can be pushed into the door 12 at the same time. However, the bolt 42 cannot be pushed into the door 12 if the lock pin 44 is already pushed into the door 12. A typical strike plate 46 is shown in FIG. 7. It has a generally rectangular cavity 114 which allows the bolt 42 to extend through the strike plate 46 when the door is closed, but prevents the lock pin 44 from extending out of the door. Thus, the bolt 42 can be retracted into the door only by turning the handle 14. A modified strike plate 116 having lock pin notch 118 is shown in FIG. 8. The modified strike plate 116 allows both the bolt 42 and lock pin 44 to extend through the strike plate 116. This allows the operating shaft 36 of the keyless entry mechanism 10 to push both the bolt 42 and lock pin 44 into the door. The notch 118 may be filed into the existing strike plate 46, or alternatively, the existing strike plate 46 could be easily replaced with a manufactured modified strike plate 116.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A keyless entry mechanism for unlocking and unlatching a lock, comprising:

(a) a housing;

(b) an operating shaft having an extended and a retracted position, said operating shaft being positioned within said housing and operably aligned to extend out of said housing to contact a bolt of the lock, said operating shaft having a notch;

(c) a shaft drive positioned within said housing and operably connected to said operating shaft to extend said operating shaft, said shaft drive biasing said operating shaft in said extended position; and (d) an actuation mechanism operationally positioned within said housing, said actuation mechanism having a catch designed to latch within said notch of said operation shaft when said operating shaft is in said retracted position, said actuation mechanism releasing said catch from said notch to permit said shaft drive to move said operating shaft to said extended position, said actuation mechanism further comprising a receiver for receiving radio frequency actuation signals and a release system for releasing said catch from said notch upon detection of a radio frequency actuation signal transmitted from a remote transmitter.

2. The keyless entry mechanism of claim 1, wherein said operating shaft has a cocking handle extending out of said housing, said cocking handle providing a manual mechanism for moving said operating shaft from said extended position to said retracted position.

3. The keyless entry mechanism of claim 1, wherein said operating shaft has a head for contacting the bolt, a neck, and a body, wherein said neck connects said head to said body.

4. The keyless entry mechanism of claim 3, wherein said neck is an extendible neck having an adjustable length.

5. The keyless entry mechanism of claim 4, wherein said extendible neck has a distal portion and a proximal portion, wherein said distal portion has a distal set of adjusting apertures and said proximal portion has a proximal set of adjusting apertures, wherein said extendible neck is set to a desired length by aligning said distal set of adjusting apertures with said proximal set of adjusting apertures at a desired length and tightening one or more adjusting screws.

6. The keyless entry mechanism of claim 3, wherein said operating shaft has a rear adjustment bracket fitted around said body, wherein said housing has a supporting bracket in control of said operating shaft, wherein said rear adjustment bracket is affixed to said body at a predetermined position and contacts said supporting bracket to prevent said operating shaft from extending beyond a desired limit.

7. The keyless entry mechanism of claim 1, wherein said shaft drive is a spring operably positioned between said housing and said operating shaft.

8. The keyless entry mechanism of claim 7, wherein said housing has a backstop and wherein said operating shaft has a body with a set of projections, wherein said spring is a leaf spring operably positioned between said backstop and said set of projections.

9. The keyless entry mechanism of claim 7, wherein said operating shaft has a neck and an adjustment bracket attached at a predetermined distance along said neck, wherein said housing has a supporting bracket in contact with said operating shaft, wherein said spring is a helical spring operably positioned between said adjustment bracket and said supporting bracket.

10. The keyless entry mechanism of claim 1, wherein said release system comprises a solenoid including a slug, and further comprises a release catch attached to said slug, wherein said operating shaft has a notch, wherein said release catch latches within said notch when said operating shaft is retracted, wherein said actuation signal energizes said solenoid to raise said release catch and unlatch said operating shaft.

11. The keyless entry mechanism of claim 1, further comprising a power supply for providing electrical power to said actuation mechanism.

12. A keyless entry mechanism for unlocking and unlatching a door, wherein the door has a lock with a bolt, said keyless entry mechanism comprising:

(a) a housing positioned in a wall adjacent to the lock in the door, said housing having at least one supporting bracket;

(b) an operating shaft having an extended position and a retracted position, said operating shaft being slidably positioned within said housing and operably aligned to extend out of said housing, wherein said operating shaft contacts and pushes the bolt into the door, said operating shaft including a head, a neck, and a body having a notch, wherein said operating shaft is supported within said housing by said at least one supporting bracket;

(c) a shaft drive positioned within said housing and operably connected to said operating shaft in such a manner as to extend said operating shaft with sufficient force to push the bolt into the door, wherein said shaft drive is a spring operably positioned between said housing and said operating shaft, said shaft drive biasing said operating shaft in said extended position;

(d) an actuation mechanism operationally positioned within said housing, said actuation mechanism having a catch designed to latch within said notch of said operation shaft when said operating shaft is in said retracted position, said actuation mechanism releasing said catch from said notch to permit said shaft drive to move said operating shaft to said extended position, said actuation mechanism further comprising a receiver for receiving radio frequency actuation signals and a release system for releasing said catch from said notch upon detection of a radio frequency actuation signal transmitted from a remote transmitter, said release system including a solenoid having a slug, said catch being attached to said slug, said actuation signal energizing said solenoid to release said catch from said notch; and (e) a power supply for providing electrical power to said actuation mechanism.

* * * * *